US008644535B2

(12) United States Patent
Steinbuss

(10) Patent No.: US 8,644,535 B2
(45) Date of Patent: Feb. 4, 2014

(54) METHOD FOR ADJUSTING A HEARING DEVICE AND CORRESPONDING HEARING DEVICE

(75) Inventor: Andre Steinbuss, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 597 days.

(21) Appl. No.: 12/607,114

(22) Filed: Oct. 28, 2009

(65) Prior Publication Data

US 2010/0104123 A1 Apr. 29, 2010

(30) Foreign Application Priority Data

Oct. 28, 2008 (DE) ..... 10 2008 053 457

(51) Int. Cl.
*H04R 25/00* (2006.01)

(52) U.S. Cl.
USPC ..... 381/314; 381/323; 381/60

(58) Field of Classification Search
USPC ..... 381/314, 323, 60
See application file for complete search history.

(56) References Cited

U.S. PATENT DOCUMENTS 4,972,487 A * 11/1990 Mangold et al. ..... 381/315
6,785,394 B1 8/2004 Olsen et al.
7,889,879 B2 * 2/2011 Dillon et al. ..... 381/314
2004/0190737 A1 9/2004 Kuhnel et al.
2005/0129262 A1 6/2005 Dillon et al.
2006/0222194 A1 10/2006 Bramslow et al.
2007/0237346 A1 10/2007 Fichtl et al.
2008/0226105 A1 9/2008 Barthel et al.

FOREIGN PATENT DOCUMENTS

EP 0335542 A2 10/1989
EP 1414271 A2 4/2004
EP 1906700 A2 4/2008
WO 03098970 A1 11/2003

OTHER PUBLICATIONS

European Search Report dated Feb. 25, 2010.

* cited by examiner

*Primary Examiner* — Davetta W Goins
*Assistant Examiner* — Amir Etesam
(74) *Attorney, Agent, or Firm* — Laurence A. Greenberg; Werner H. Stemer; Ralph E. Locher

(57) ABSTRACT

A method for adjusting a hearing device, in particular a hearing aid, to an individual user, includes firstly recording data relating to at least one setting of the hearing device together with direct or indirect temporal information. Thereupon, a period of time during which the at least one setting was/is active is automatically determined. Finally, at least one parameter of the hearing device is automatically adapted as a function of the determined period of time and the at least one setting. This affords the possibility of adapting, for example, time constants according to individual usage. A corresponding hearing device is also provided.

5 Claims, 1 Drawing Sheet

METHOD FOR ADJUSTING A HEARING DEVICE AND CORRESPONDING HEARING DEVICE

CROSS-REFERENCE TO RELATED APPLICATION

This application claims the priority, under 35 U.S.C. §119, of German Patent Application DE 10 2008 053 457.9, filed Oct. 28, 2009; the prior application is herewith incorporated by reference in its entirety.

BACKGROUND OF THE INVENTION

Field of the Invention

The present invention relates to a method for adjusting a hearing device. According to the method, one or more parameters of the hearing device are automatically adapted. Moreover, the present invention relates to a corresponding hearing device. The term "hearing device" in this case is understood to mean any portable sound-emitting equipment in/on the ear or on the head, in particular a hearing aid, a headset, earphones or the like.

Hearing aids are portable hearing devices used to support the hard of hearing. In order to make concessions for numerous individual requirements, different types of hearing aids are provided, e.g. behind the ear (BTE) hearing aids, hearing aids with an external earpiece (receiver in the canal [RIC]) and in the ear (ITE) hearing aids, for example concha hearing aids or canal hearing aids (ITE, CIC) as well. The hearing aids, which are listed in an exemplary fashion, are worn on the concha or in the auditory canal. Furthermore, bone conduction hearing aids, implantable or vibrotactile hearing aids are also commercially available. In that case, a damaged sense of hearing is stimulated either mechanically or electrically.

In principle, the main components of a hearing aid are an input transducer, an amplifier and an output transducer. In general, the input transducer is a sound receiver, e.g. a microphone, and/or an electromagnetic receiver, e.g. an induction coil. The output transducer is usually constructed as an electroacoustic transducer, e.g. a miniaturized loudspeaker, or as an electromechanical transducer, e.g. a bone conduction earpiece. The amplifier is usually integrated into a signal processing unit. That basic structure is illustrated in FIG. 1 using the example of a behind the ear hearing aid. One or more microphones 2 for recording sound from the surroundings are installed in a hearing aid housing 1 to be worn behind the ear. A signal processing unit 3, likewise integrated in the hearing aid housing 1, processes the microphone signals and amplifies them. An output signal of the signal processing unit 3 is transferred to a loudspeaker or earpiece 4 which emits an acoustic signal. If necessary, the sound is transferred to the eardrum of the equipment wearer by using a sound tube which is fixed in the auditory canal with an ear mold. A battery 5, likewise integrated into the hearing aid housing 1, supplies the hearing aid and in particular the signal processing unit 3 with energy.

European Patent Application EP 1 906 700 A2, corresponding to U.S. Patent Application Publication No. US 2008/0226105, discloses a method for a time-controlled setting of a hearing device. To that end, a hearing situation is firstly automatically classified. Subsequently, a parameter of the signal processing device of the hearing device is set and the parameter set for the current situation is automatically learned. However, in the process the steps "classifying" and "setting" are monitored with respect to time and the automatic learning is only initiated once the classified hearing situation and the parameter settings remain unchanged for a predetermined period of time. That can simplify and accelerate the training.

Modern digital hearing aids, such as the one described above, learn preferred settings with respect to volume and tone from the user of the hearing aid. The learning is effected as a function of the input signal.

In addition to the definition of adequate step lengths, it is necessary to define suitable time constants in such a way that on one hand the learning is so rapid that the user feels the advantage of the changed algorithm, but on the other hand learning should progress so slowly that a sufficiently large number of learned changes are present in order to be able to reliably identify the wishes of the user. These wishes of the user do not only relate to the volume and tone, as mentioned, but also, for example, to entire hearing programs.

Time constants are generally determined for certain programs or functions. Those time constants are then defined for a platform and transferred to the various products. Problems often occur when the user uses not only one hearing program but many hearing programs. In that case, the learning time is reduced under the assumption that the wearing time per day is constant but the learning time is distributed more or less evenly over the various programs. However, that assumption does not necessarily have to correspond to the individual usage and therefore the aid learns the individual programs either too quickly or too slowly.

Until now, that problem was not addressed in any greater detail. Rather, the time constants were generally predefined and configured on the basis of the number of programs or the fictitious usage time thereof (e.g. telephoning).

SUMMARY OF THE INVENTION

It is accordingly an object of the invention to provide a method for adjusting a hearing device and a corresponding hearing device, which overcome the hereinafore-mentioned disadvantages of the heretofore-known methods and devices of this general type and which improve the adjustment of a hearing device and in particular a hearing aid to the individual usage of a hearing device wearer.

With the foregoing and other objects in view there is provided, in accordance with the invention, a method for adjusting a hearing device. The method comprises recording data relating to at least one setting of the hearing device together with direct or indirect temporal information, automatically determining a period of time during which the at least one setting was or is active, and automatically adapting at least one parameter of the hearing device as a function of the determined period of time and the at least one setting.

With the objects of the invention in view, there is also provided a hearing device, comprising a data-logging apparatus for recording data relating to at least one setting of the hearing device together with direct or indirect temporal information. An evaluation apparatus automatically determines a period of time during which the at least one setting was or is active. An adaptation apparatus automatically adapts at least one parameter of the hearing device as a function of the determined period of time and the at least one setting.

Advantageously, this affords the possibility of acquiring the individual usage time of settings individually and adjusting the adapting or learning of the hearing device to the individual usage times. By way of example, this affords the possibility of relatively quickly learning programs, which on average are only used very rarely, while more time is allocated for learning programs which are used for longer. In a specific example, the learning time for frequently used programs can thus, for example, be set to 60 h, whereas the learning time for a rarely used program is only intended to be 1 hour. By way of example, a long learning time is disadvantageous if a hearing aid wearer always only makes short telephone calls. Therefore, in this case, the telephone program should be adapted as quickly as possible or the respective parameters should be learned as quickly as possible. Although fast learning is connected to a drop in quality, this is of little consequence since the respective program is rarely used in any case.

Preferably, setting the method according to the invention corresponds to activating a hearing program. This means that the data logging records how long a hearing program is used. It follows that, as mentioned above, the adaptation can be effected as a function of the usage time of a program and therefore programs which are used for a long time can be adapted very finely.

However, setting the hearing device can also relate to the volume or the tone. This also affords the possibility of controlling the adaptation of individual parameters individually according to usage.

Moreover, the parameter to be adapted can be a time constant or a determination time. This affords the possibility of adapting, for example, filter algorithms (e.g. noise algorithms) more or less finely depending on individual usage time.

Moreover, it is advantageous if the parameter to be adapted is changed continuously. This means that the hearing aid wearer or user notices the adaptation less.

Other features which are considered as characteristic for the invention are set forth in the appended claims.

Although the invention is illustrated and described herein as embodied in a method for adjusting a hearing device and a corresponding hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
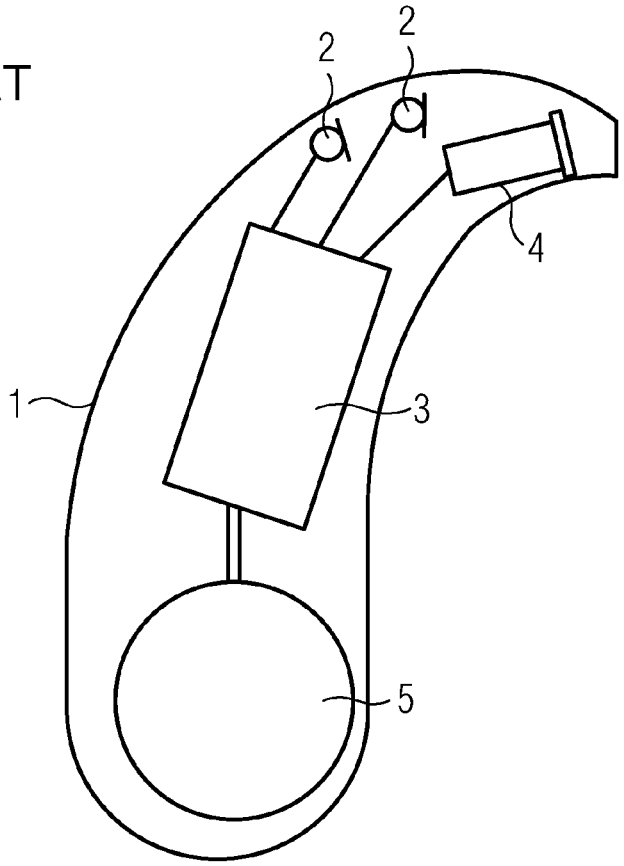
FIG 1 PRIOR ART
FIG. 1 is a diagrammatic, side-elevational view of a hearing aid according to the prior art.
Figure 2:
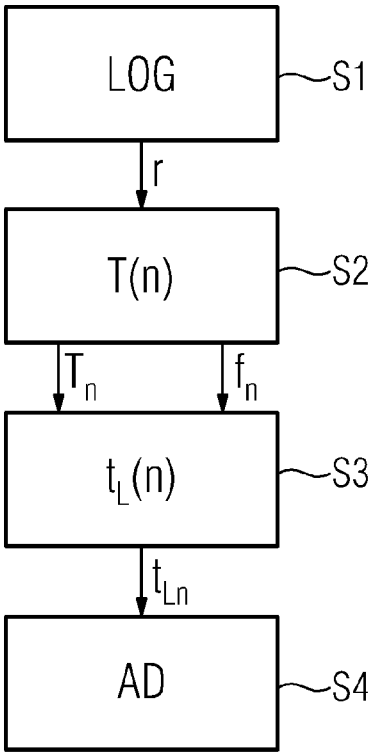
FIG. 2 is a flowchart relating to the progression of a method according to the invention.

Referring now in detail to the figures of the drawings, which illustrate exemplary embodiments that are described in more detail below and constitute preferred embodiments of the invention, and first, particularly, to FIG. 2 thereof, there is seen a flowchart of an example of a method according to the invention for adjusting a hearing aid, which starts by recording data in the hearing aid according to step S1. In this case, this constitutes data logging, i.e. data is recorded together with temporal information. This temporal information can be recorded explicitly, or the temporal information can be implicitly contained in the data in such a way that it can be reconstructed. In other words, a corresponding hearing aid has a data logging unit which can record data. The recorded data is raw data r, which can be reproduced if necessary.

In step S2, there is temporal evaluation of the raw data r. The temporal evaluation is effected in this case as a function of n programs. Thus, on one hand, usage times $T_n$ of the individual programs emerge from the temporal evaluation. On the other hand, frequencies $f_n$ can be determined during the temporal evaluation, which frequencies specify how often every program was changed.

This temporal data (in this case the usage time and the frequency of change per program) is supplied for further evaluation according to step S3. There, the usage times $T_n$ and the frequencies of change $f_n$ are used to determine a learning time $t_{ln}$. This means that learning times are determined for each program according to the individual usage behavior. These learning times are used for learning according to step S4.

As indicated above, step S1 in a hearing aid is effected in recording and storage equipment. The temporal evaluation according to steps S2 and S3 can be effected in an appropriately constructed computational unit. Adaptation according to step S4 is effected in an adaptation apparatus which uses the results of the calculation or evaluation apparatus.

In conclusion, it can be established that the method described above can adapt a time constant or an averaging time according to the individual usage of different programs. The equipment obtains the information required to this end with respect to the usage time of the individual programs from data logging. The determined usage time per program is used to derive a suitable time constant for the learn function in an adaptive and possibly continuous fashion.

Thus, the advantage for the hearing aid wearer resulting from this is that training time is oriented to the individual usage of that wearer. This can even be ensured if the preferences for the stored hearing programs change.

The invention claimed is:

1. A method for adjusting a hearing device, the method comprising:

recording data relating to at least one setting of the hearing device together with direct or indirect temporal information;

automatically determining a period of usage time during which the at least one setting was or is active;

automatically adapting at least one parameter of the hearing device as a function of the determined period of usage time and the at least one setting during a period of learning time; and controlling the period of learning time for the automatic adaptation of the at least one parameter on a basis of the period of usage time determined earlier.

2. The method according to claim 1, wherein the setting relates to an activation of a hearing program, a volume, a tone or a control range for noise reduction.

3. The method according to claim 1, wherein the at least one parameter to be adapted is a time constant or an averaging time.

4. The method according to claim 1, which further comprises continuously changing the at least one parameter to be adapted.

5. A hearing device, comprising:

a data-logging apparatus for recording data relating to at least one setting of the hearing device together with direct or indirect temporal information;

an evaluation apparatus for automatically determining a period of usage time during which the at least one setting was or is active;

an adaptation apparatus for automatically adapting at least one parameter of the hearing device as a function of the determined period of usage time and the at least one setting during a period of learning time; and a control apparatus for controlling the period of learning time for the automatic adaptation of the at least one parameter on a basis of the period of usage time determined earlier.

* * * * *